US011795695B2

(12) United States Patent
Henriksen et al.

(10) Patent No.: US 11,795,695 B2
(45) Date of Patent: Oct. 24, 2023

(54) FLASHING ASSEMBLY FOR A ROOF PENETRATING STRUCTURE AND A METHOD FOR MANUFACTURING A FLASHING ASSEMBLY

(71) Applicant: VKR Holding A/S, Hørsholm (DK)

(72) Inventors: Jens-Ulrik Holst Henriksen, Århus (DK); Søren Frederiksen, Odder (DK)

(73) Assignee: VKR Holding A/S

( * ) Notice: Subject to any disclaimer, the term of this patent is extended or adjusted under 35 U.S.C. 154(b) by 178 days.

(21) Appl. No.: 17/420,804

(22) PCT Filed: Sep. 25, 2020

(86) PCT No.: PCT/DK2020/050263
§ 371 (c)(1),
(2) Date: Jul. 6, 2021

(87) PCT Pub. No.: WO2021/058073
PCT Pub. Date: Apr. 1, 2021

(65) Prior Publication Data

US 2022/0090384 A1 Mar. 24, 2022

(30) Foreign Application Priority Data

Sep. 25, 2019 (DK) ..... PA 2019 70589

(51) Int. Cl.
*E04D 13/147* (2006.01)
*E04D 13/03* (2006.01)

(52) U.S. Cl.
CPC ..... *E04D 13/1475* (2013.01); *E04D 13/03* (2013.01)

(58) Field of Classification Search
CPC ..... E04D 13/1475; E04D 13/14; E04D 13/03
See application file for complete search history.

(56) References Cited

U.S. PATENT DOCUMENTS

2006/0123713 A1* 6/2006 Faurholdt ..... E04D 13/02 52/58
2014/0123569 A1 5/2014 Smith
2014/0190104 A1 7/2014 Nicholson
2014/0259973 A1 9/2014 Duarte et al.
2018/0347180 A1 12/2018 Thomsen et al.
2022/0090384 A1* 3/2022 Henriksen ..... E04D 13/1475

FOREIGN PATENT DOCUMENTS

CN 1146227 3/1997
DE 2554341 6/1977
(Continued)

OTHER PUBLICATIONS

International Search Report dated Nov. 25, 2020 issued in connection with International Application No. PCT/DK2020/050263, 2 pages.

(Continued)

*Primary Examiner* — Andrew J Triggs
(74) *Attorney, Agent, or Firm* — Merek, Blackmon & Voorhees, LLC

(57) ABSTRACT

A flashing assembly for use with a roof penetrating structure, such as a roof window, in an inclined roof of a building is disclosed. It comprises a bottom flashing element and at least one side flashing element, both of which are provided with a bend portion bent away from the interior side towards the exterior side and forming a water drainage channel, which extends along an edge. The dimensions of the flashing elements are such that the two water drainage channels extend in continuation of each other in the mounted condition of the flashing assembly, and least one of the water drainage channels has a U-shape in a cross-section perpendicular to the edge of the flashing element along which is extends. A method for manufacturing a flashing assembly is also disclosed.

20 Claims, 5 Drawing Sheets

(56) References Cited

FOREIGN PATENT DOCUMENTS

| | | |
|---|---|---|
| EP | 1424455 | 6/2004 |
| EP | 2333191 | 6/2011 |
| EP | 2937489 | 10/2015 |
| EP | 3031997 | 6/2016 |
| FR | 2916464 | 11/2008 |
| WO | WO01/65029 | 9/2001 |

OTHER PUBLICATIONS

International Preliminary Report on Patentability dated May 12, 2021 issued in connection with International Application No. PCT/DK2020/050263, 8 pages.
Machine generated translation of FR2916464.
Search opinion dated Mar. 23, 2020 issued in Danish Patent Application No. PA 2019 70589, eight (8) pages.
2nd technical examination report dated Oct. 20, 2020 issued in Danish Patent Application No. PA 2019 70589, three (3) pages.
English translation of Office Action dated Apr. 6, 2022 issued in connection with corresponding Chinese Patent Application No. 202080007978.4, eleven (11) pages.
Search Report dated May 3, 2022 issued in connection with corresponding European Application No. 20785433.2, seven (7) pages.
English translation of Report dated Jul. 29, 2022 issued in connection with Japanese Patent Application No. 2021-540816, thirteen (13) pages.

* cited by examiner

FLASHING ASSEMBLY FOR A ROOF PENETRATING STRUCTURE AND A METHOD FOR MANUFACTURING A FLASHING ASSEMBLY

TECHNICAL FIELD

The present invention relates to a flashing assembly for use with a roof penetrating structure, such as a roof window, in an inclined roof of a building, the inclined roof having an inclination direction and comprising roof covering elements, the roof penetrating structure comprising a top member and a bottom member adapted for extending across the inclination direction in a mounted condition, and a first side member and a second side member adapted for extending in the inclination direction in the mounted condition, where the flashing assembly comprises a bottom flashing element and at least one side flashing element, where the bottom flashing element comprises:

a bottom sealing member comprising a first sealing member portion, a second sealing member portion and a third sealing member portion, where the first sealing member portion is configured for being attached to and extending along the bottom member of the roof penetrating structure, where the second sealing member portion is configured for extending along the first side member of the roof penetrating structure, and where the third sealing member portion is configured for extending along the second side member of the roof penetrating structure, a skirt member having a first edge attached to the bottom sealing member, a second and a third edge extending from the first edge, and a fourth edge, opposite the first edge, where the skirt member is configured for extending over roof covering elements positioned below the roof penetrating structure in the inclination direction in the mounted condition with an interior side facing the roof covering elements, and a bottom corner member having a first edge attached to the second or third sealing member portion, a second edge attached to the skirt member, a third edge opposite the first edge and a fourth edge opposite the second edge, where the first edge and the third edge are converging so that the distance between them is bigger at the second edge than at the fourth edge, and where the bottom corner member has an interior side configured for facing an interior of the building in a mounted condition and an exterior side opposite the interior side, where the at least one side flashing element comprises a first side portion configured for extending in an exterior direction away from the roof and along the side member of the roof penetrating structure, and a second side portion extending at an angle to and away from the first side member of the roof penetrating structure, such that in the mounted condition it extends in a direction across the inclination direction of the roof, said second side portion having a first edge extending along the first side portion and a second edge opposite the first side portion, and a third and a fourth edge extending between the first and second edges, and where the second side portion has an interior side configured for facing an interior of the building in a mounted condition and an exterior side opposite the interior side and where the side flashing element is configured for overlapping the bottom corner member of the bottom flashing element in the mounted condition with the fourth edge of the second side portion extending adjacent to the fourth edge of the bottom corner member.

The invention further relates to a method for manufacturing a flashing assembly.

BACKGROUND

Flashing assemblies are typically used to seal the joints between roof penetrating structures and the roof in which they are mounted. To this end, a bottom flashing element is arranged at the bottom member of the roof penetrating structure, side flashing elements along the side members, and a top flashing member at the top member, so that the flashing elements together form a flashing frame surrounding the roof penetrating structure. The top flashing member as well as the bottom flashing member may comprises corner members arranged at the side members of the roof penetrating structure for providing an overlap with the side flashing members. The bottom flashing member comprises a skirt member configured for resting on the exterior surface of the roof covering elements, which may for example be tiles, undulated plates, or slate, and is usually deformed to match the shape of the roofing elements.

An upright edge portion may be provided on the side flashing elements and on corner members to deflect water entering sideways underneath the roof coverings elements, i.e. in a direction across the inclination direction, for example under the influence of wind.

An example of such a flashing assembly is disclosed in FR2916464, and today virtually all roof windows installed in inclined roofs in Europe are provided with such a flashing assembly.

Practice, however, has shown that in roofs with a relative low inclination, particularly at inclinations lower than 15 degrees or where the roof is particularly exposed to wind, water may still enter into the roof structure in spite of such a flashing assembly being installed.

It is therefore an object of the invention to provide a flashing assembly with improved weatherproofing abilities.

SUMMARY

According to a first aspect of this invention, this object is met with a flashing assembly according to the introduction where the bottom corner member of the bottom flashing element comprises a bend portion bent away from the interior side towards the exterior side of the bottom corner member and forming a water drainage channel, which extends along the third edge of the bottom corner member, where the second side portion of the side flashing element comprises a bend portion bent away from the interior side towards the exterior side of the second side portion and forming a water drainage channel, which extends along the second edge of the second side portion, where the length of the fourth edge of the second side portion from its first edge to its bend portion relative to the length of the fourth edge of the bottom corner member from its first edge to its bend portion is such that the water drainage channel of the bottom corner member and the water drainage channel of the second side portion extend in continuation of each other in the mounted condition, and where the water drainage channel of the bottom corner member and/or the water drainage channel of the second side portion has a U-shape in a cross-section perpendicular to the edge of the flashing element along which it extends.

The U-shape means that the bend portion includes a section extending substantially in parallel with a main body of the bottom corner member/second side portion and at a distance above it in a height direction extending perpendicular to the third and fourth edges. In the mounted condition the height direction extends perpendicular to the plane of the roof. In other words, the main body of the bottom corner member/second side portion constitutes a first leg of the U, while a second leg of the U extends above it, back towards the first edge. This entails an improved weatherproofing as the risk of water and/or wind passing over the third edge of the bottom corner member or over the second edge of the second side portion it considerably reduced.

A further advantage may be that water will be safely channelled to flow in a specific direction or path e.g. towards a particular draining area below the bottom corner member.

Further still, the U-shape of the water drainage channel may have the advantage that the bend portion is less susceptible to being deformed than the traditional upright edges known from the prior art. This means that the risk of the bend portion losing its functionality, for example by being unintentionally deformed so that it is flattened or turning outwards away from the first edge, is considerably reduced. Such a deformation may e.g. occur during installation of the roof covering elements or in connection with maintenance work, where someone steps on the roof covering elements arranged on top of the flashing elements.

Still further the U-shape of the water drainage channel may enable the bend portion to flex slightly and follow movements of the roof covering elements if, for example, they are lifted by heavy winds thus potentially improving the weathertightness.

The U-shape of the water drainage channel of at least one flashing element may be continuously rounded, composed of three or more straight sections, or a combination thereof. In one embodiment two substantially parallel side segments constituting the two legs of the U are connected by a middle segment that is substantially perpendicular to the side segments.

The bend portion may be bent more than 180 degrees so that the two legs of the U-shape converge.

The size of the water drainage channel will depend on the amount of water to be drained off by the flashing assembly, which will in turn depend on factors such as the climate zone and the size of the roof penetrating structure. The size may vary over the length of the water drainage channel. In one embodiment the water drainage channel of the bottom corner member has a height of at least 30 mm in a direction perpendicular to the third and fourth edges of the bottom corner member. The height of the channel may be at least 35, at least 40 mm, or at least 45 mm, preferably between 30 mm and 45 mm as a larger height may influence negatively on the tightness between roof covering elements and the aesthetic properties of the roof penetrating structure in the mounted condition.

The bend portion may have a flat length before bending extending substantially perpendicularly from the third edge of at least 30 mm. The flat length of the bend portion may be at least 35 mm, such as 40 mm, 45 mm, 50 mm, 55 mm, 60 mm and 65 mm. Preferably between 35 mm and 50 mm.

It is presently considered advantageous that the water drainage channel extends along substantially the entire length of the side flashing element and along the entire third edge of the bottom corner member.

The flashing assembly may further comprise a top flashing element may also be provided with a U-shaped bend portion forming a water drainage channel extending in upwards continuation of the water drainage channel of the side flashing element seen in the inclination direction.

The side flashing element may be configured for extending along the entire side member of the roof penetrating structure, i.e. from the top flashing element to the bottom flashing element, but it is also possible to use two or more shorter side flashing elements arranged in overlapping continuation of each other along the side of the roof penetrating structure. Such shorter side flashing elements may be identical, but it is also possible for example to have a base side flashing element, which is used with all roof penetrating structures, and a series of supplemental side flashing elements, one or more of which are used with larger roof penetrating structures depending on the length of the side members.

The reference to the length of the fourth edge of the second side portion from the first edge to the bend portion relative to the length of the fourth edge of the bottom corner member from the first edge to the bend portion is to be understood such that these lengths substantially equal but not necessarily identical. In one embodiment the length at the fourth edge of the second side portion is slightly smaller than the length at the fourth edge of the bottom corner member to allow the side flashing member to fit between the second or third sealing member portion and the bend portion of the bottom corner member. It may, however, also be advantageous that the length at the fourth edge of the second side portion is equal to or even slightly larger than the length at the fourth edge of the bottom corner member so that the side flashing member is wedged between the second or third sealing member portion and the bend portion of the bottom corner member. This latter embodiment is particularly relevant where at least the side flashing element is made from an elastic material, such as sheet metal.

The skirt member too may comprise a bend portion bent in the exterior direction and forming a water drainage channel extending along the second or third edge of the skirt member, wherein the width of the skirt in a direction parallel to the first edge is such that the water drainage channel of the skirt member extends in continuation of the water drainage channel of the bottom corner member in the mounted condition.

This may have the advantage of further improving the weathertightness of the flashing assembly as the area covered by a water drainage channel may be increased. Furthermore, water drained in the water drainage channel of the bottom corner member may be guided/drained away more effectively by extending into the channel of the skirt member.

To facilitate the drainage of water from the side flashing member over the bottom corner member and onto the skirt member the third edge of the bottom corner member preferably extends at an angle to the first edge of 30-60 degrees. The angle may vary or it may be the same along the length of third edge and may have a magnitude of 20-70, 30-60, 40-50, 42-48 or substantially 45 degrees to the respective side member.

The flashing assembly may further comprise a top flashing element may also be provided with a U-shaped bend portion forming a water drainage channel extending in upwards continuation of the water drainage channel of the side flashing element seen in the inclination direction.

In one embodiment at least the side flashing element and the bottom corner member are made of metal, preferably aluminium. Copper, steel, zinc or alloys may also be used. Alternatively, one or more flashing elements or parts therefore may be made from a polymer. The skirt member may for example include a layer of bitumen or a similar polymer to provide it with deformability and plasticity, and for the same reason at least a portion of the skirt member may be made of a corrugated sheet material.

The skirt member may comprise a flat flange member at the second and/or third edge.

Throughout this disclosure, the term "flat" may be understood as the flange member of the skirt member being plane and/or non-corrugated in a state of delivery. It may be a section of corrugated sheet material that has been stretched to a plane sheet material. Alternatively, the flange member may be a separate member attached to a main body of the skirt member, and such a separate flange member may for example be made from a different material than the main body of the skirt member, such as for example rubber.

The flat surface as opposed to the corrugated surface may be advantageous if this part is to be arranged between roof covering elements, as the roof covering element positioned on top of the flange member can then come closer to the roof covering element(s) underneath the flange member. Thus, a tighter fit is provided which is particularly advantageous in low pitched roofs and in connection with small windows.

Two or more of the bottom sealing member, the skirt member, and the bottom corner member may be made in one piece.

In the above, the bottom flashing element has been described with referenced to a bottom flashing element having a single bottom corner member. This may be advantageous if the roof penetrating structure is installed close to a wall, another roof penetrating structure or the like. If the roof penetrating structure is installed in the roof at a distance from other items, the bottom flashing element may comprise two bottom corner members, which are substantially identical, but mirror-inverted, where the first edge of one bottom corner member is attached to the second sealing member portion and the first edge of the other bottom corner member is attached to the third sealing member portion.

A second aspect of the invention relates to a method for manufacturing a flashing assembly according to the first aspect, comprising the step of:

providing a bottom flashing element comprising a bottom sealing member, a skirt member, and a bottom corner member, providing at least one side flashing element comprising a first side portion and a second side portion, where the side flashing element is configured for overlapping the bottom corner member of the bottom flashing element in the mounted condition, bending a portion of the bottom corner member of the bottom flashing element away from the interior side towards the exterior side of the bottom corner member thereby forming a water drainage channel, which extends along the third edge of the bottom corner member, bending a portion of the second side portion of the side flashing element away from the interior side towards the exterior side of the second side portion thereby forming a water drainage channel, which extends along the second edge of the second side portion, and dimensioning the length of the fourth edge of the second side portion from its first edge to its bend portion relative to the length of the fourth edge of the bottom corner member from its first edge to its bend portion such that the water drainage channel of the bottom corner member and the water drainage channel of the second side portion extend in continuation of each other in the mounted condition.

In this way, a flashing with improved weathertightness may be manufactured.

The method may comprise the further step of:

bending a portion of the skirt member away from the interior side towards an opposite exterior side thereby forming a water drainage channel, wherein the bend portion of the skirt member is configured for being positioned in continuation of the bend portion of the bottom corner member, preferably bending the portion of the skirt member at the same time as bending the portion of the bottom corner member.

Bending the bend portion of the bottom corner member and the skirt in the same step may provide a more weathertight seal between them and hence a more weathertight flashing assembly.

BRIEF DESCRIPTION OF DRAWINGS

The flashing assembly will now be described in greater detail based on non-limiting exemplary embodiments and with reference to the drawings, on which.

Similar reference numerals are used for similar elements across the various embodiments and figures described herein.

DETAILED DESCRIPTION

Figure 1:
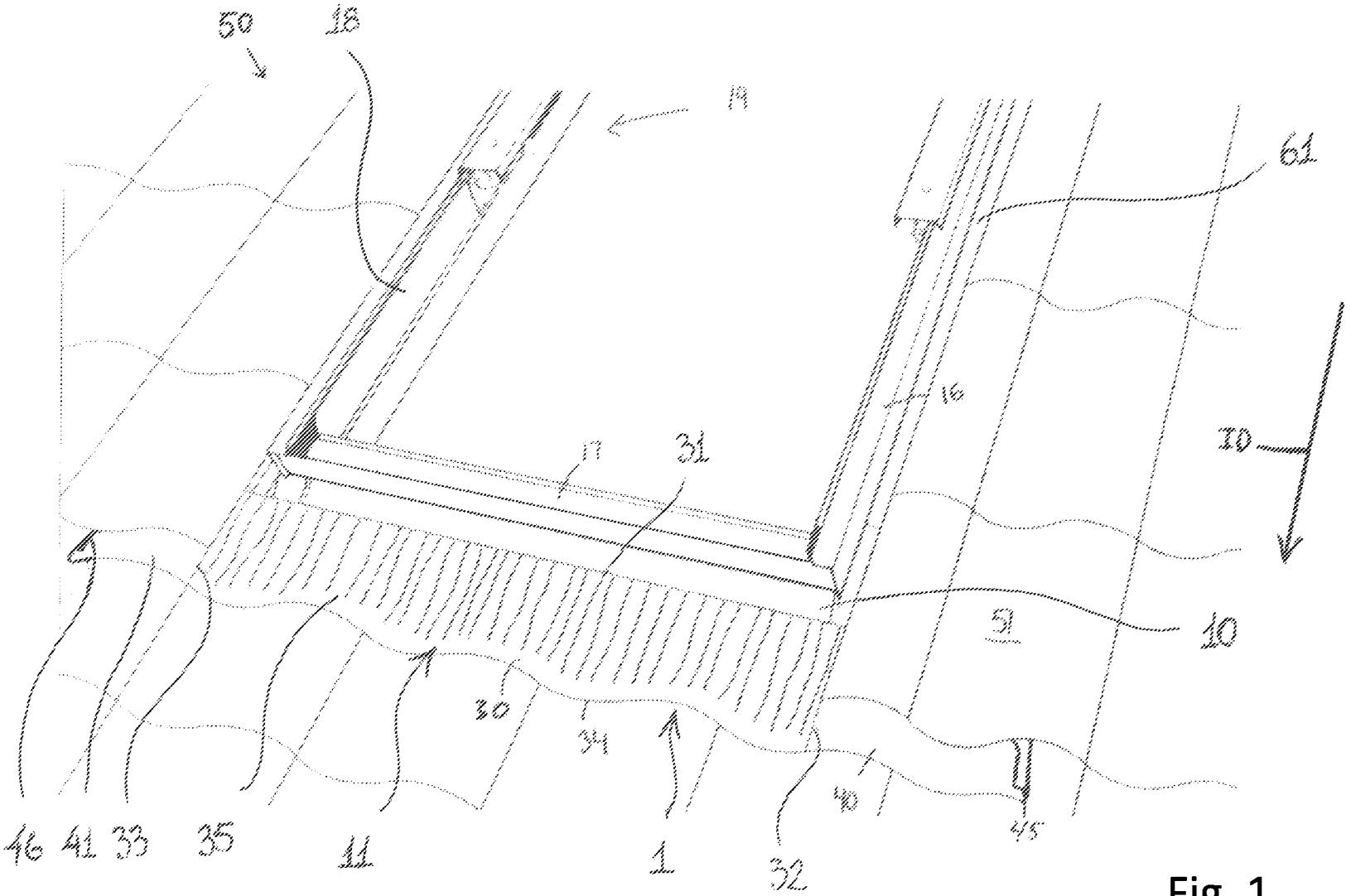
FIG. 1 shows a flashing assembly in a mounted condition in a perspective view.

A roof penetrating structure 19 in the form of a roof window is shown mounted in a roof 50 in FIG. 1. The window comprises a first side member 16 and a second side member 18 interconnecting a bottom member 17 and a top member (not shown). The roof 50 is inclined in the inclination direction ID and is covered by undulated roof covering elements 51 in the form of tiles.

A flashing assembly 1 seals the joints between the roof penetrating structure 19 and the roof 50. It comprises a bottom flashing element 11 extending along the bottom member 17 of the roof penetrating structure and two side flashing elements 61, only one of which are visible in FIG. 1, each extending along substantially the entire length of a side member 16, 18 of the roof penetrating structure.

Figure 2:
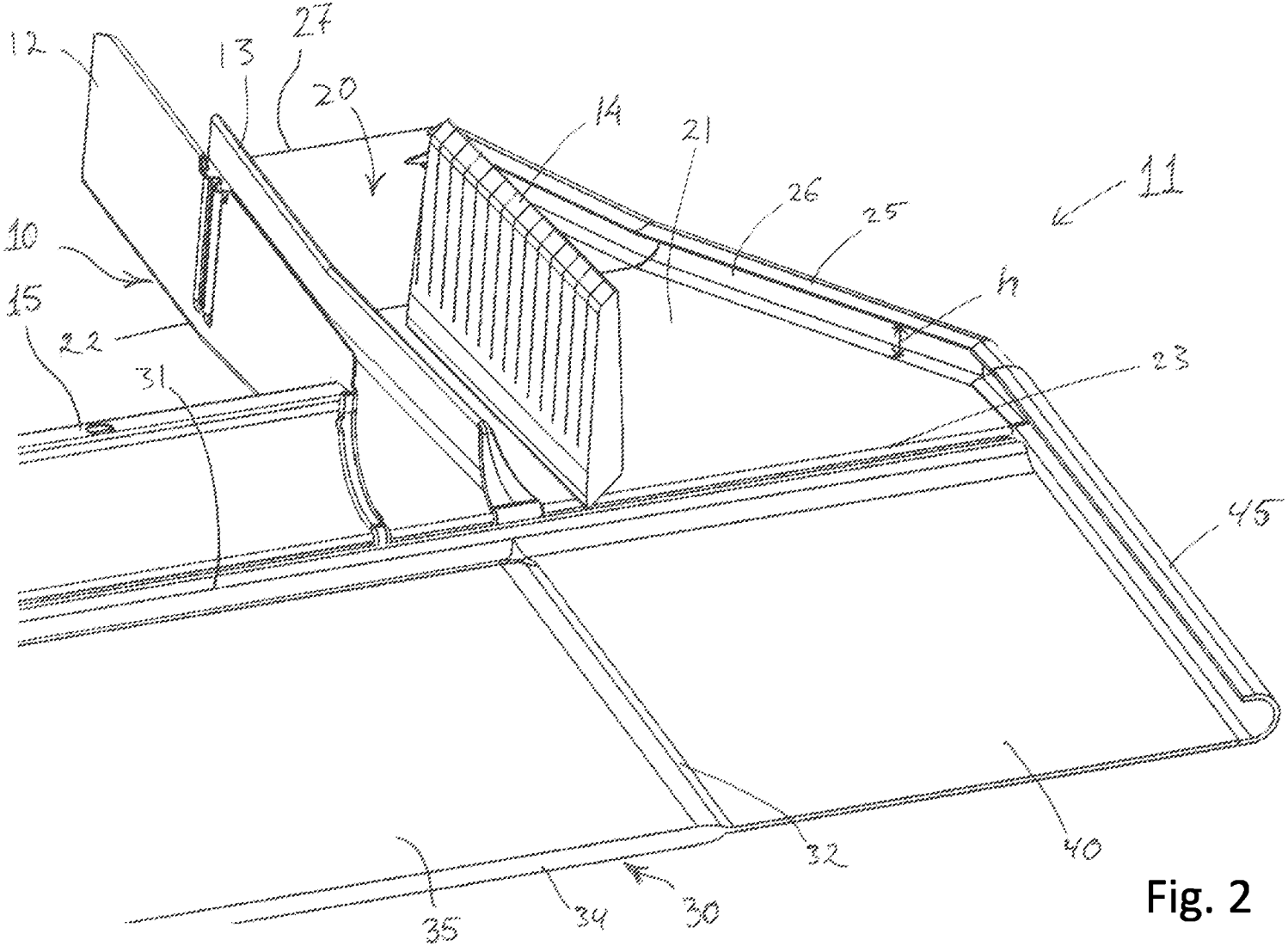
FIG. 2 is a partially cut-away perspective view of a bottom flashing element.
Figure 3:
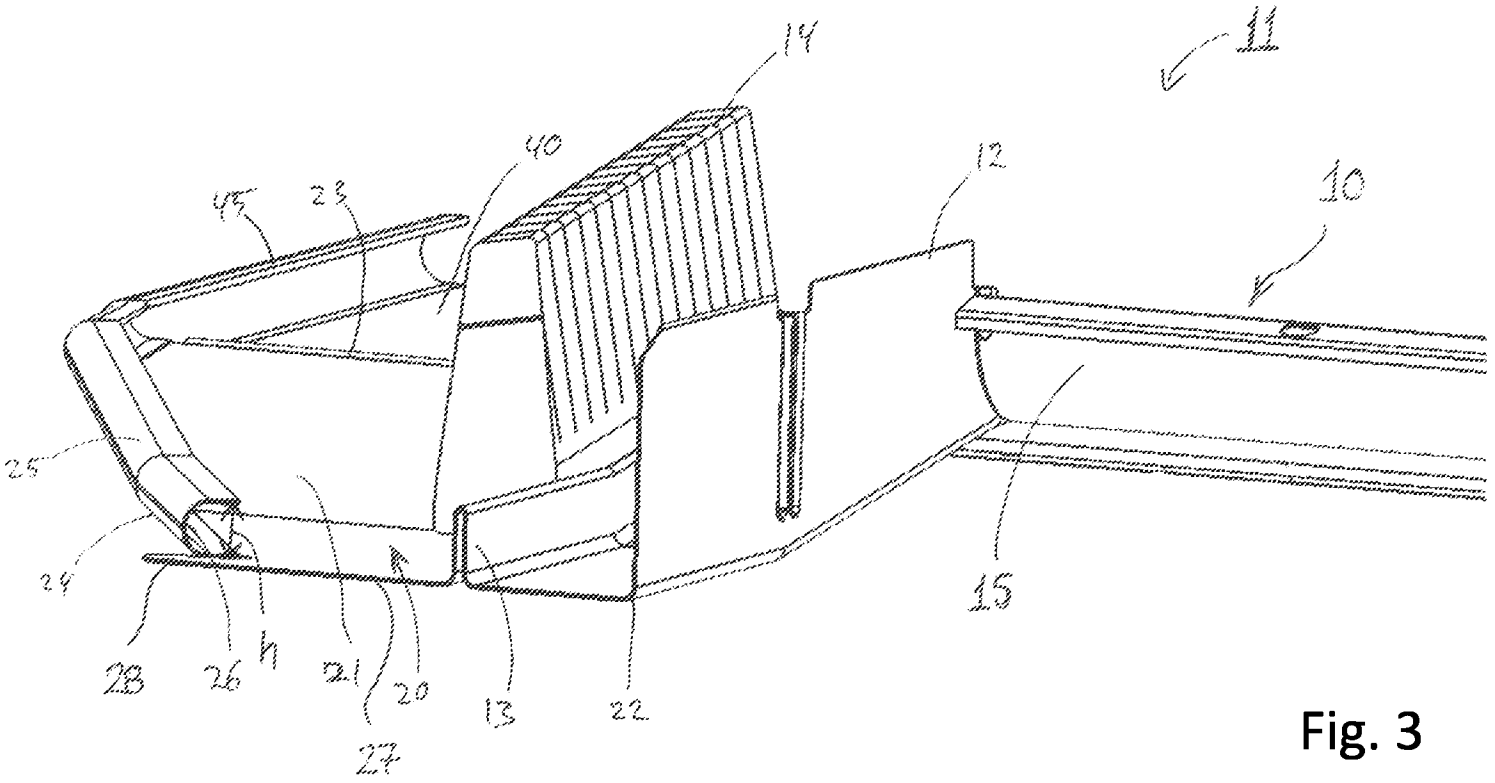
FIG. 3 shows the section of the bottom flashing element in FIG. 2 from another angle.

Turning now also to FIGS. 2 and 3, which show the righthand end of the bottom flashing element 11 in FIG. 1, the bottom flashing element comprises a bottom sealing member 10 having a first sealing member portion in the form of a rail element 15 and a second sealing member portion 12, a bottom corner member 20, and a skirt member 30. It is to be understood that a bottom corner member is also found at the opposite end of the bottom flashing element.

The first sealing member portion in the form of the rail element 15 is attached to and extends along the bottom member 17 of the roof penetrating structure in FIG. 1, and the second sealing member portion 12 extends upwards along the first side member 16 of the roof penetrating structure. It is to be understood that a third sealing member portion extends along the second side member 18 of the roof penetrating structure even though not shown in the drawing, said third sealing member portion being identical to the second sealing member portion 12, except for being mirror-inverted.

A skirt member 30 is attached to along the rail element 15 along a first edge 31 in a manner well-known to the skilled person.

The bottom corner member 20 comprises a main body 21, a first edge 22, which in a mounted state extends in the inclination direction ID, a second edge 23, a third edge 24, a fourth edge 27, and a bend portion 25. Further it comprises a raised section 13 in the form of a bend on the main body 21 and a wedge-shaped foam strip 14, both extending in parallel with the first edge.

The first edge 22 extends along and is connected to the second sealing member portion 12 and the second sealing member portion 12 is here formed in one piece with bottom corner member main body 21. The bend portion 25 extends away from the interior side of the bottom corner member 20, which is facing downwards in FIGS. 2 and 3, and is bend towards the exterior side of main body 21, thereby forming a U-shaped water drainage channel 26 extending along the third edge 24. In other words, due to the third edge 24 of the bottom corner element not being parallel to the first edge 22, the opening of the U-shape faces towards the skirt member 30 and the second sealing member portion 12.

The water drainage channel 26 has a height h measured from the main body 21 towards the exterior, i.e. in a direction perpendicular to the third and fourth edges of the bottom corner member. The channel height h, i.e. the gap between the two legs of the U-shape, is here 30 mm. In other embodiments, the channel height h may be less than 30 mm, such as 28 mm, 26 mm, 24 mm, 22 mm, or less, or more than 30 mm, such as 32 mm, 34 mm, 36 mm, 38 mm, or more. The flat length of the bend portion 25 before bending is here 45 mm to accommodate the channel height of 30 mm, but may be different if the shape or curvature of the water drainage channel 26 is different.

In this embodiment the skirt member 30 comprises a main body 35 and a first flange member 40, which are interconnected at an edge 32. The first flange member 40 is further connected to the second edge 23 of the bottom corner member 20, but it is to be understood that the main body of the skirt member may extend all the way to the third edge 24 of the bottom corner member 20.

The skirt member 30 further comprises a second flange member 41 connected to the main body at edge 33 at the opposite end of the bottom corner member 20 as may be seen in FIG. 1. The second flange member 41 is connected to a second bottom corner member (not shown) in a similar manner as the first flange member 40 is connected to the first bottom corner member 20. The second flange member 41 is identical to the first flange member 40, except for being mirror-inverted.

The first flange member 40 comprises a bend portion 45, which extends in continuation of the bend portion 25 of the first bottom corner member 20. The bend portion 45 as substantially the same shape and size as the bend portion 25 of the bottom corner member 20 and thus serves as an extension of the U-shaped water drainage channel 26. The second flange member 41 similarly comprises a bend portion 46, which extends along an edge of the second flange member 41.

The flange members 40, 41 are made from a flat material, which is easily formed according to the shape of the tiles 51, and the tile resting on top of the flange members 40, 41 can thus be brought close to the tile underneath it. The flange members 40, 41 may be stretched so that it can reach over the undulated roof covering elements 51. As seen in FIG. 1, the roof covering elements 51 may slightly deform a portion of the flange member bends 45, 46, which, nonetheless, each provide a flange member channel extending into a respective channel 26.

The skirt member 30 further has a fourth edge 34 resting on top of the roof covering elements 51 below the roof window 19 when seen in the inclination direction ID, and the main body 35 is corrugated by being folded along lines extending between the first edge 31 and the fourth edge 34. The corrugation facilitates deformation to match the shape of the roof covering elements 51 as shown in FIG. 1.

Figure 4:
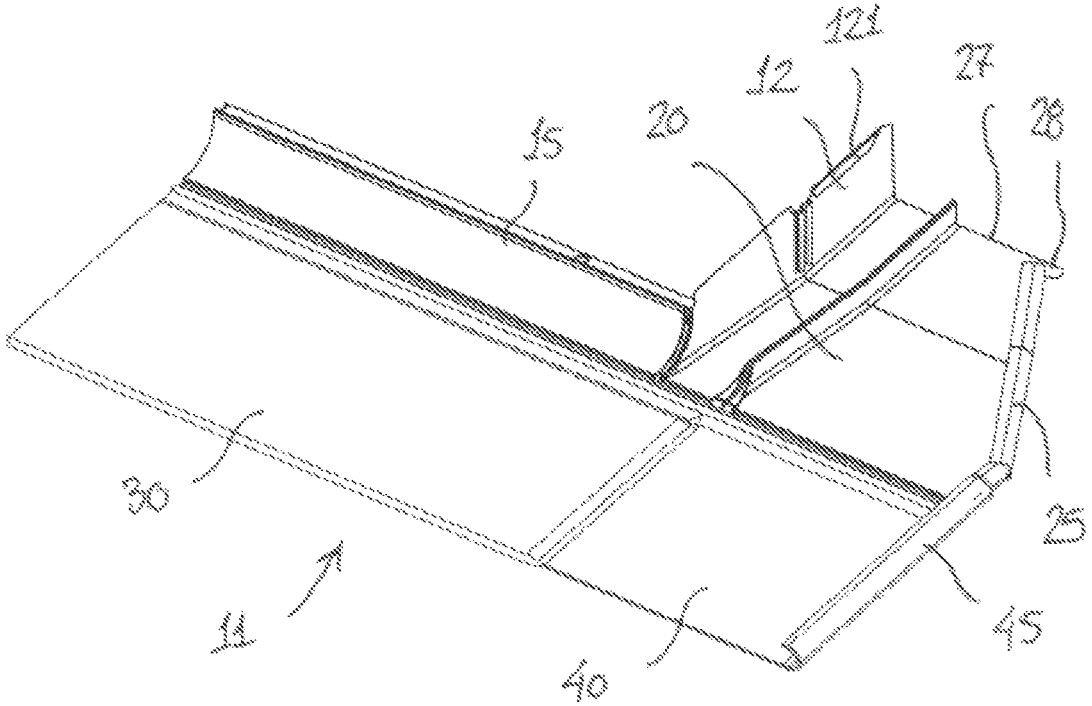
FIG. 4 shows the section of the bottom flashing element in FIGS. 2 and 3 from yet another angle and with the foam strip removed.

FIG. 4 shows the bottom flashing element from yet another angle and with the foam strip 14 removed. The foam strip serves to close a possible gap between a roof covering element 51 and the bottom corner member 20 in a manner well known to the skilled person and will therefore not be described in further detail.

Figure 5:
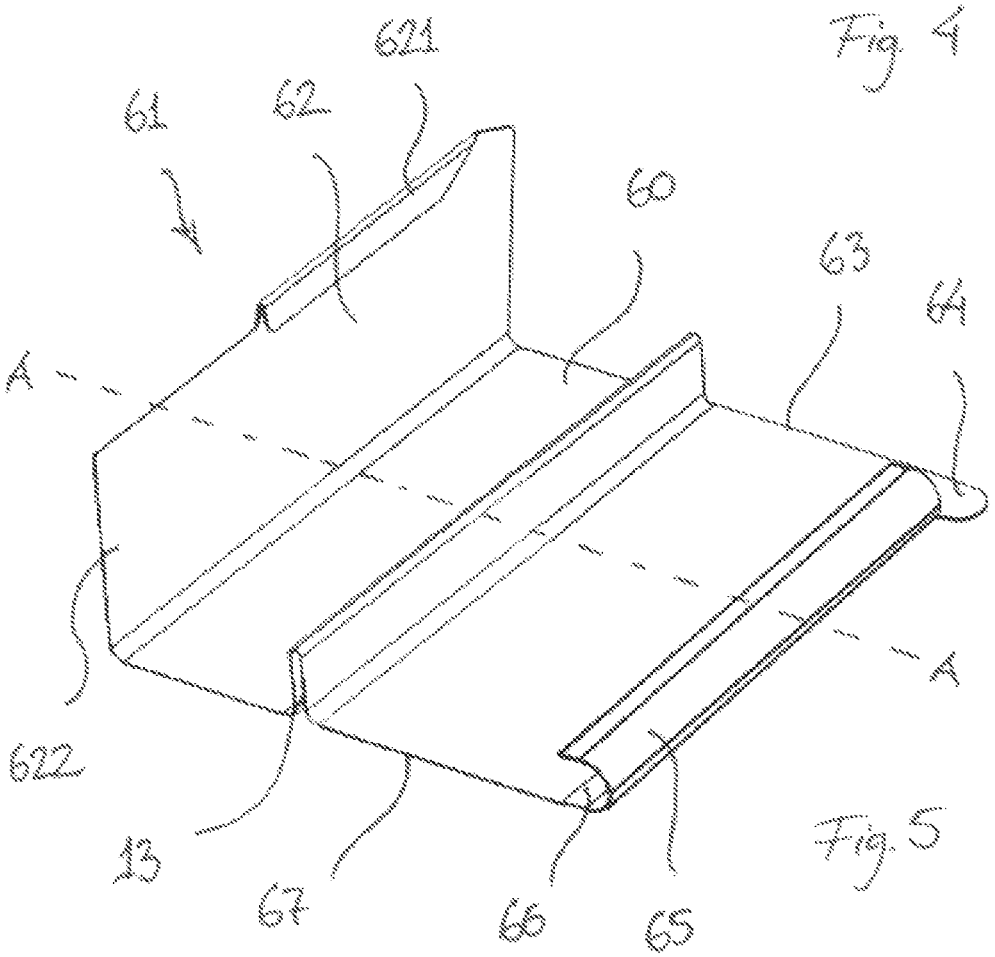
FIG. 5 is a perspective view of a side flashing element.

FIG. 5 shows a side flashing element 61, which is considerably shorter than shown in FIG. 1. Either a series of such short side flashing elements may be used in continuation of each other along the length of the side member 16 of the roof penetrating structure 19 or the section of the side flashing element located below the line A-A in FIG. 5 may be simply be made longer to match the length of the side member.

The side flashing member 61 comprises a first side portion 62 attached to the side member 16 of the roof penetrating structure 19 in the mounted condition as shown in FIG. 1, and a second side portion 60 extending at an angle to and away from the first side member in a direction across the inclination direction ID of the roof 50.

As described above with reference to the bottom corner member 20, the second side portion 60 of the side flashing element 61 also comprises a bend portion 65 bent away from the interior side towards the exterior side and forming a water drainage channel 66, which extends along an edge of the second side portion opposite the first side portion. The bend portion 65 of the side flashing member is U-shaped and has substantially the same shape and size as the bend portion 25 of the bottom flashing element 11.

Figure 6:
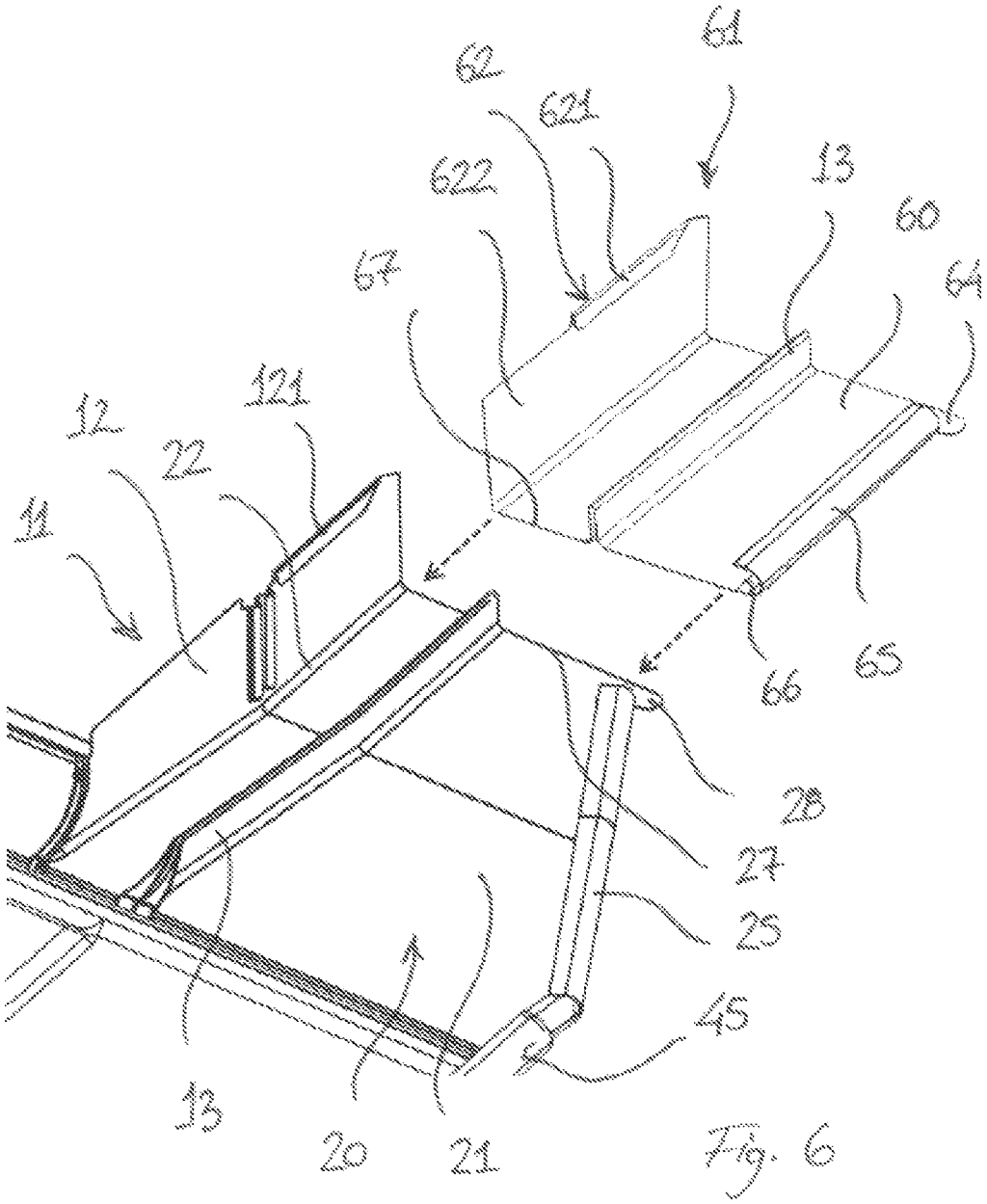
FIG. 6 is a perspective view showing how the side flashing element in FIG. 5 can be connected to the bottom flashing element in FIG. 4.

FIG. 6 shows how the bottom flashing member 11 and the side flashing member 61 may be arranged in an overlapping engagement with each other by shifting the side flashing member as indicated by the broken arrows. This results in the fourth edge 67 of the second side portion of the side flashing element 61 being arranged adjacent to the fourth edge 27 of the bottom corner member 20 and on top of the main body 21 thereof.

As may be seen, the fourth edge 67 of the second side portion has substantially the same length as the fourth edge 27 of the bottom corner member 20 measured from the first edge 22 to the bend portion 25. This means that the water drainage channel 26 of the bottom corner member and the water drainage channel 66 of the second side portion extend in continuation of each other in the mounted condition, thus forming one continuous water drainage channel. When the skirt member 30 is also provided with a bend portion 45 forming a water drainage channel as shown in the drawing, one continuous water drainage channel consisting of three separate sections will be formed.

Furthermore, by shifting the side flashing member 61 into an overlapping engagement with the bottom flashing element 11 as indicated by the broken arrows in FIG. 6, the first side portion 62 and the second sealing member portion 12 become arranged closely abutting each other. The side flashing element 61 is thus retained between the second sealing member portion 12 and the bend portion 25 of the bottom flashing element. This retention may be strengthened by making the second side portion 60 slightly oversize so that it is kept in press by the bottom corner member.

In this embodiment both the side flashing element 61 and the bottom corner member 20 have raised sections 13, which contribute to guiding and retaining the side flashing element in relation to the bottom flashing element 11 in a manner known to the skilled person. The raised sections 13 further serve to prevent water running downwards along the first side portion 62 and the second sealing member portion 12 from moving sideways across the inclination direction, for example under the influence of wind, thus potentially reducing the water load on the water drainage channels.

The second sealing member portion 12 here has a folded section 121, which contributes to guiding and retaining the side flashing element in relation to the bottom flashing element 11 by the first side portion 622 being inserted in the folded section. A similar folded sections 621 is found on the side flashing element 61 for engagement with other side flashing elements (not shown) or a top flashing element (not shown).

For still further mutual fixation both the bottom flashing element 11 and the side flashing element 61 are provided with tabs 28, 64, which are adapted for being folded over another flashing element, thereby contributing to a mutual fixation of the two elements.

The combination of these different means for guiding and fixating the two flashing elements in relation to each other provides for a simple yet reliable interconnection, which allows the flashing elements to move slightly in the mounted condition so that they may compensate for example for thermal expansion. It is, however, also possible to use other means for mutual guidance and fixation.

The invention claimed is:

1. Flashing assembly for use with a roof penetrating structure, such as a roof window, in an inclined roof of a building, the inclined roof having an inclination direction and comprising roof covering elements, the roof penetrating structure comprising a top member and a bottom member adapted for extending across the inclination direction in a mounted condition, and a first side member and a second side member adapted for extending in the inclination direction in the mounted condition, where the flashing assembly comprises a bottom flashing element and at least one side flashing element, where the bottom flashing element comprises:

a bottom sealing member comprising a first sealing member portion, a second sealing member portion and a third sealing member portion, where the first sealing member portion is configured for being attached to and for extending along the bottom member of the roof penetrating structure, where the second sealing member portion is configured for extending along the first side member of the roof penetrating structure, and where the third sealing member portion is configured for extending along the second side member of the roof penetrating structure, a skirt member having a first edge attached to the bottom sealing member, a second and a third edge extending from the first edge, and a fourth edge, opposite the first edge, where the skirt member is configured for extending over the roof covering elements positioned below the roof penetrating structure in the inclination direction in the mounted condition with an interior side facing the roof covering elements, and a bottom corner member having a first edge attached to the second or third sealing member portion, a second edge attached to the skirt member, a third edge opposite the first edge and a fourth edge opposite the second edge, where the first edge and the third edge are converging so that a distance between them is bigger at the second edge than at the fourth edge, and where the bottom corner member has an interior side configured for facing an interior of the building in a mounted condition and an exterior side opposite the interior side, where the at least one side flashing element comprises a first side portion configured for extending in an exterior direction away from the roof and along the side member of the roof penetrating structure, and a second side portion extending at an angle to and away from the first side member of the roof penetrating structure, such that in the mounted condition it extends in a direction across the inclination direction of the roof, said second side portion having a first edge extending along the first side portion and a second edge opposite the first side portion, and a third and a fourth edge extending between the first and second edges, and where the second side portion has an interior side configured for facing the interior of the building in a mounted condition and an exterior side opposite the interior side and where the at least one side flashing element is configured for overlapping the bottom corner member of the bottom flashing element in the mounted condition with the fourth edge of the second side portion extending adjacent to the fourth edge of the bottom corner member, the bottom corner member of the bottom flashing element comprises a bend portion bent away from the interior side towards the exterior side of the bottom corner member and forming a water drainage channel, which extends along the third edge of the bottom corner member, that the second side portion of the side flashing element comprises a bend portion bent away from the interior side towards the exterior side of the second side portion and forming a water drainage channel, which extends along the second edge of the second side portion, that a length of the fourth edge of the second side portion from its first edge to its bend portion relative to a length of the fourth edge of the bottom corner member from its first edge to its bend portion is such that the water drainage channel of the bottom corner member and the water drainage channel of the second side portion extend in continuation of each other in the mounted condition, and that the water drainage channel of the bottom corner member and/or the water drainage channel of the second side portion has a U-shape in a cross-section perpendicular to the edge of the flashing element along which it extends.

2. The flashing assembly according to claim 1, where the U-shape of the water drainage channel of at least one of the bottom corner member and the second side portion of the at least one side flashing element is continuously rounded, composed of three or more straight sections, or a combination thereof.

3. The flashing assembly according to claim 2 wherein the water drainage channel of the bottom corner member has a height of at least 30 mm in a direction perpendicular to the third and fourth edges of the bottom corner member, measured from a main body of the bottom corner member upwardly and away from the main body of the bottom corner member, and corresponding to a gap between two legs of the U-shape.

4. The flashing assembly according to claim 3 wherein the water drainage channel of the second side portion has a U-shape and a height substantially the same as the height of the water drainage channel of the bottom corner member.

5. The flashing assembly according to claim 1, wherein the water drainage channel of the bottom corner member has a height of at least 30 mm in a direction perpendicular to the third and fourth edges of the bottom corner member.

6. The flashing assembly according to claim 1, wherein the water drainage channel extends along substantially an entirety of the length of the side flashing element and along an entirety of the third edge of the bottom corner member.

7. The flashing assembly according to claim 1, wherein the at least one side flashing element includes two or more side flashing elements arranged in overlapping continuation of each other along one side member of the roof penetrating structure.

8. The flashing assembly according to claim 1, wherein the skirt member comprises a bend portion bent in the exterior direction and forming a water drainage channel extending along the second or third edge of the skirt member, and wherein a width of the skirt in a direction parallel to the first edge is such that the water drainage channel of the skirt member extends in continuation of the water drainage channel of the bottom corner member in the mounted condition.

9. The flashing assembly according to claim 1, wherein the third edge of the bottom corner member extends at an angle to the first edge of 30-60 degrees.

10. The flashing assembly according to claim 1, wherein at least the side flashing element and the bottom corner member are made of metal.

11. The flashing assembly according to claim 1, wherein at least a portion of the skirt member is of a corrugated sheet material.

12. The flashing assembly according to claim 1, wherein the skirt member comprises a flat flange member at the second and/or third edge.

13. The flashing assembly according to claim 1, wherein two or more of the bottom sealing member, the skirt member, and the bottom corner member are made in one piece.

14. The flashing assembly according to claim 1, wherein the bottom flashing element comprises two bottom corner members being substantially identical, but mirror-inverted, where the first edge of one bottom corner member is attached to the second sealing member portion and the first edge of the other bottom corner member is attached to the third sealing member portion.

15. The flashing assembly according to claim 1, further comprising a top flashing element provided with a U-shaped bend portion forming a water drainage channel extending in upwards continuation of the water drainage channel of the side flashing element seen in the inclination direction.

16. A method for manufacturing a flashing assembly comprising a bottom flashing element and at least one side flashing element, said method comprising the step of:

providing the bottom flashing element comprising:

a bottom sealing member comprising a first sealing member portion, a second sealing member portion and a third sealing member portion, where the first sealing member portion is configured for attachment to a bottom member of a roof penetrating structure and for extending along the bottom member of the roof penetrating structure, where the second sealing member portion is configured for extending along a first side member of the roof penetrating structure, and where the third sealing member portion is configured for extending along a second side member of the roof penetrating structure, a skirt member having a first edge attached to the bottom sealing member, a second and a third edge extending from the first edge, and a fourth edge, opposite the first edge, said second and third edges connecting the first edge with the fourth edge, where the skirt member is configured for extending over roof covering elements positioned below the bottom member of the roof penetrating structure in a mounted condition with an interior side facing the roof covering elements, and a bottom corner member having a first edge attached to the second or third sealing member portion, a second edge attached to the skirt member, a third edge opposite the first edge and a fourth edge opposite the second edge, where the first edge and the third edge are converging so that a distance between them is bigger at the second edge than at the fourth edge, and where the bottom corner member has an interior side configured for facing an interior of a building in a mounted condition and an exterior side opposite the interior side, providing at least one side flashing element comprising:

a first side portion configured for attachment to the first side member of the roof penetrating structure and for extending along the first side member of the roof penetrating structure, and a second side portion extending at an angle to and away from the first side member of the roof penetrating structure, such that in the mounted condition it extends in a direction across an inclination direction of a roof, said second side portion having a first edge extending along the first side portion and a second edge opposite the first side portion, and a third and a fourth edge extending between the first and second edges, and where the second side portion has an interior side configured for facing the interior of the building in the a mounted condition and an exterior side opposite the interior side, and where the side flashing element is configured for overlapping the bottom corner member of the bottom flashing element in the mounted condition with the fourth edge of the second side portion of the side flashing element extending adjacent to the fourth edge of the bottom corner member, bending a portion of the bottom corner member of the bottom flashing element away from the interior side towards the exterior side of the bottom corner member thereby forming a water drainage channel, which extends along the third edge of the bottom corner member, bending a portion of the second side portion of the side flashing element away from the interior side towards the exterior side of the second side portion thereby forming a water drainage channel, which extends along the second edge of the second side portion, and dimensioning a length of the fourth edge of the second side portion from its first edge to its bend portion relative to a length of the fourth edge of the bottom corner member from its first edge to its bend portion such that the water drainage channel of the bottom corner member and the water drainage channel of the second side portion extend in continuation of each other in the mounted condition, wherein the water drainage channel of the bottom corner member and/or the water drainage channel of the second side portion has a U-shape in a cross-section perpendicular to the edge of the flashing element along which it extends.

17. The method according to claim 16, comprising the further step of:

bending a portion of the skirt member away from the interior side towards an opposite exterior side thereby forming a water drainage channel, wherein the bend portion of the skirt member is configured for being positioned in continuation of the bend portion of the bottom corner member.

18. The method according to claim 17, comprising:

bending the portion of the skirt member at the same time as bending the portion of the bottom corner member.

19. The method according to claim 16, wherein the water drainage channel of the bottom corner member has the U-shape in cross-section perpendicular to the third edge of the bottom corner member, and wherein the water drainage channel of the bottom corner member has a height of at least 30 mm in a direction perpendicular to the third and fourth edges of the bottom corner member, measured from a main body of the bottom corner member towards the exterior, and corresponding to a gap between two legs of the U-shape.

20. The method according to claim 16, wherein the water drainage channel of the second side portion has the U-shape in cross-section perpendicular to the second edge of the second side portion and a height substantially equal to a height of the water drainage channel of the bottom corner member.

* * * * *